United States Patent [19]

Larson

[11] 4,132,052

[45] Jan. 2, 1979

[54] APPARATUS FOR REMOVING BUNGS FROM KEGS

[75] Inventor: Robert M. Larson, Mequon, Wis.

[73] Assignee: Jos. Schlitz Brewing Company, Milwaukee, Wis.

[21] Appl. No.: 812,127

[22] Filed: Jul. 1, 1977

[51] Int. Cl.[2] ..... B67B 7/42; B65B 57/00

[52] U.S. Cl. ..... 53/75; 29/822; 53/367; 53/381 A

[58] Field of Search ..... 53/381 A, 367, 75; 29/714, 822; 81/3.33; 193/32, 40; 214/304

[56] References Cited

U.S. PATENT DOCUMENTS

| | | | |
|---|---|---|---|
| 1,819,032 | 8/1931 | Lehman | 193/40 |
| 2,297,330 | 9/1942 | Schoepfer | 193/32 X |
| 2,940,229 | 6/1960 | Baker | 53/381 A X |
| 3,613,332 | 10/1971 | Davis | 53/381 A |
| 4,024,621 | 5/1977 | Hodgetts | 53/381 A X |

*Primary Examiner*—Travis S. McGehee

*Attorney, Agent, or Firm*—Andrus, Sceales, Starke & Sawall

[57] ABSTRACT

An apparatus for removing bungs from kegs. A walking beam moves the keg sequentially from a receiving station on a feed conveyor to an orienting station, a debunging station, a probe station, a reject station to a discharge conveyor. At the orienting station the keg is rotated to position the bung downwardly, and an auger removes the downwardly facing bung at the debunging station. At the probe station, a probe senses the presence of improperly removed bungs, and kegs with improperly removed bungs are rejected from the line at the reject station. Kegs with properly removed bungs are delivered to the discharge conveyor.

15 Claims, 22 Drawing Figures

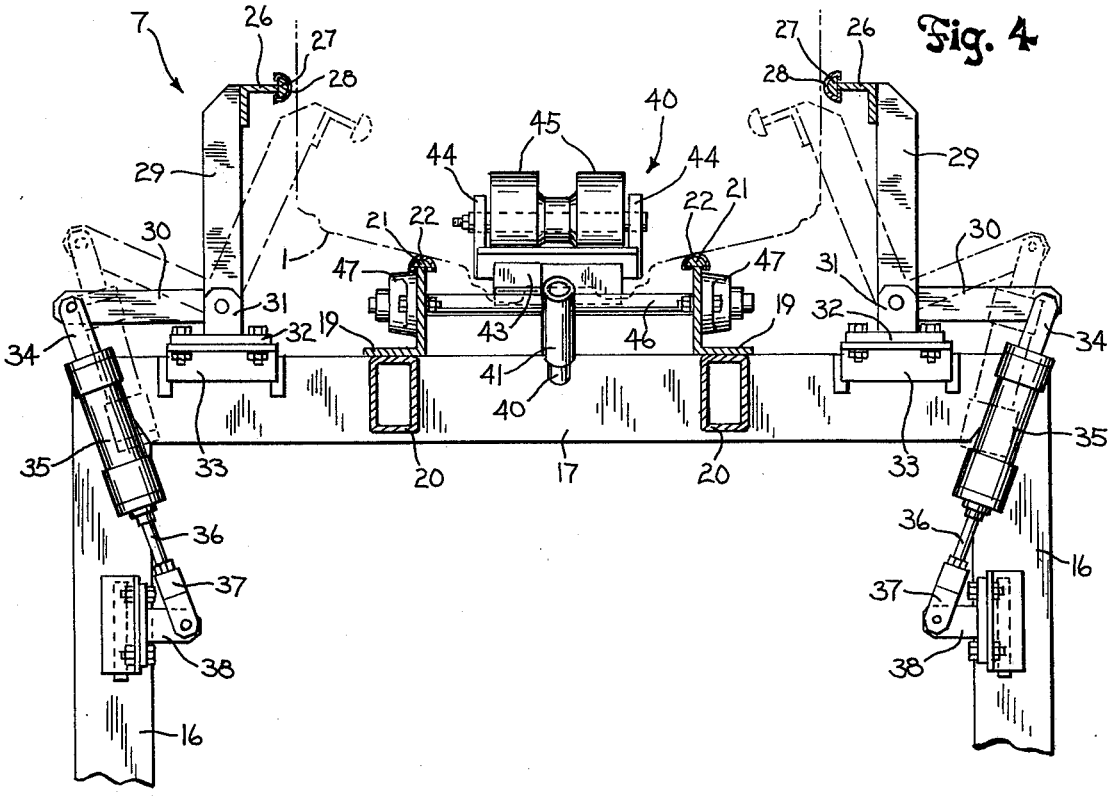
Fig. 4
Fig. 11
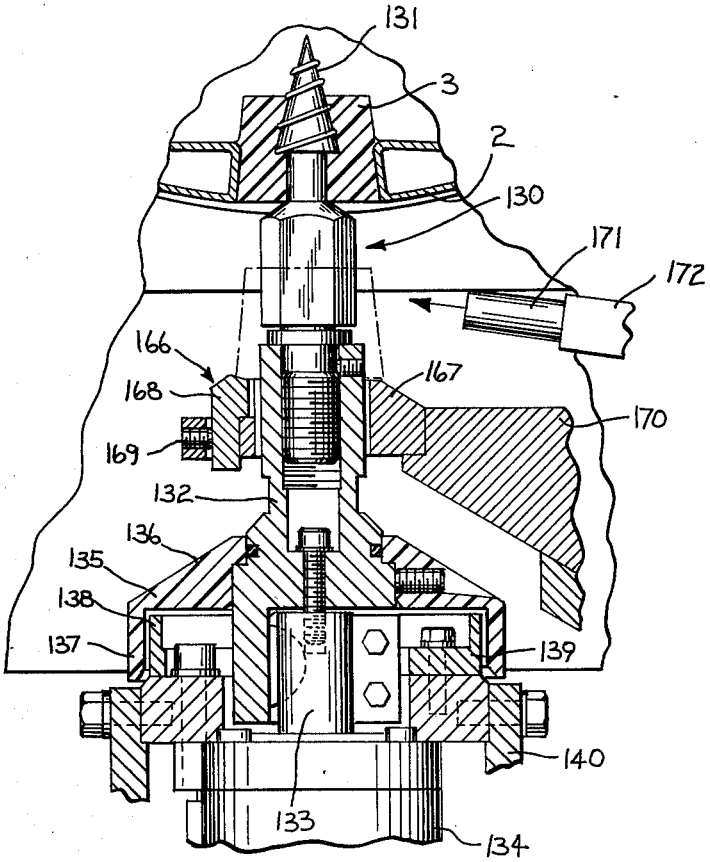

Fig. 9
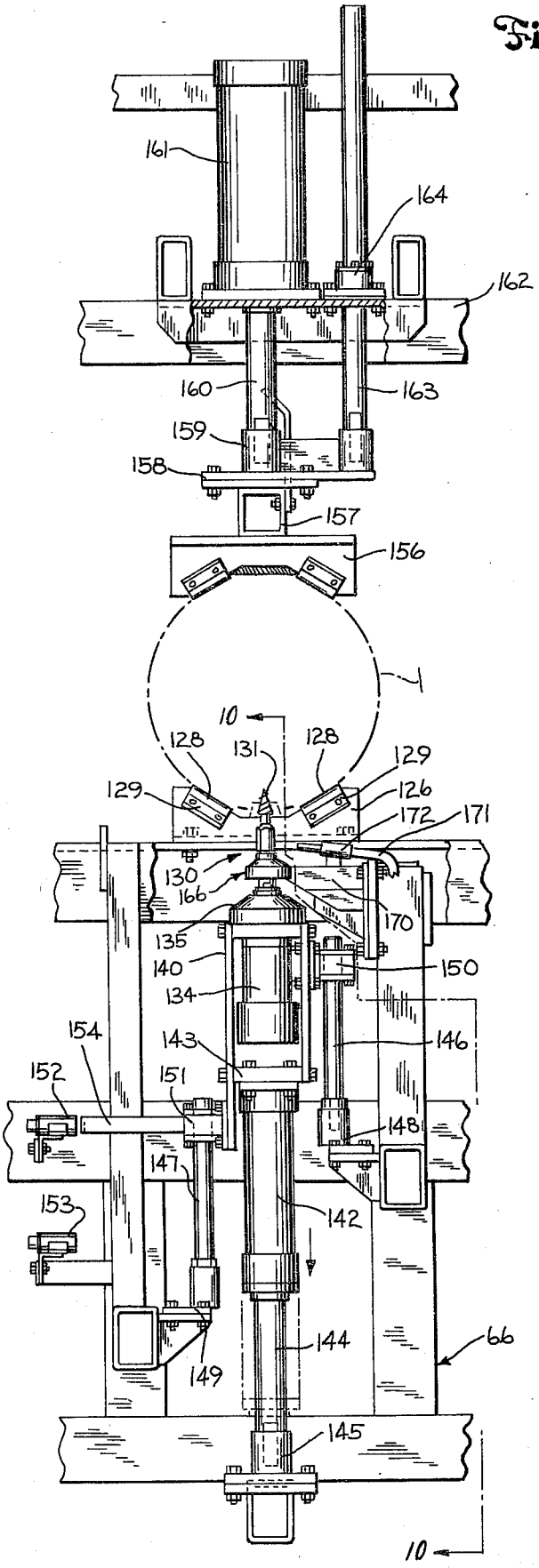
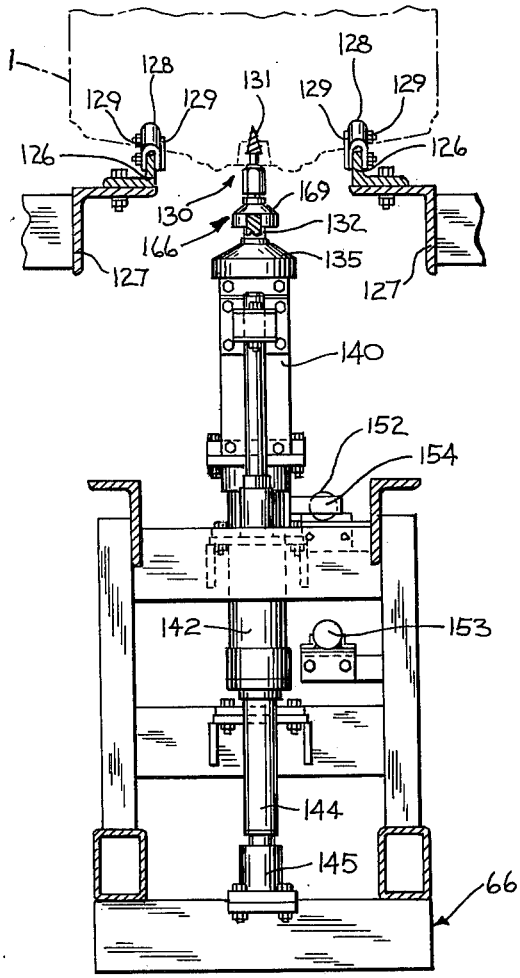
Fig. 10

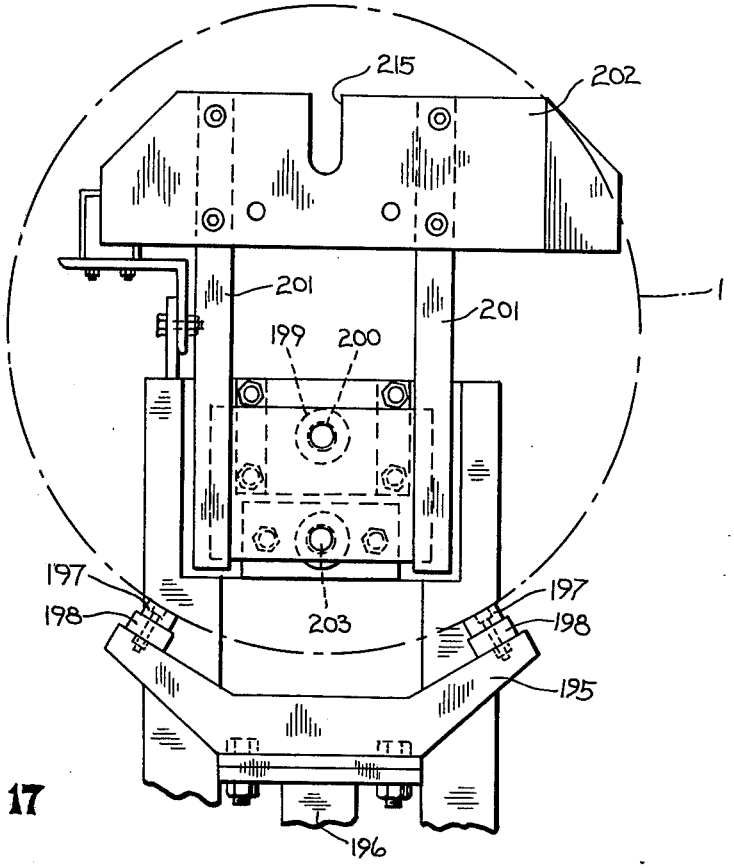
Fig. 17
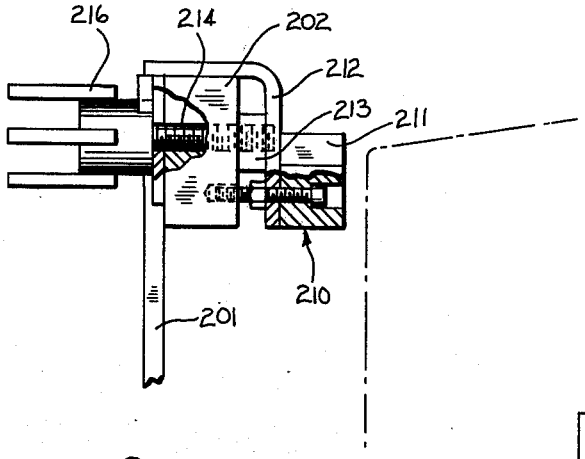
Fig. 18
Fig. 19
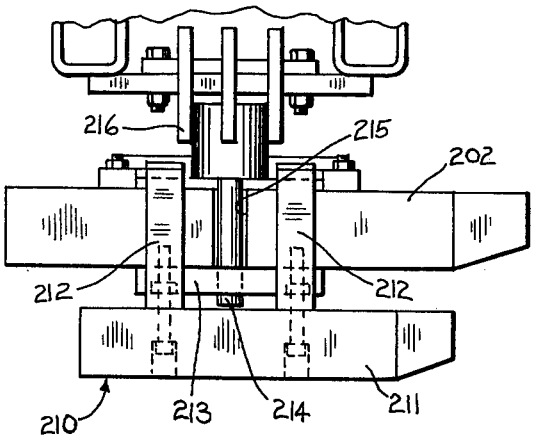

APPARATUS FOR REMOVING BUNGS FROM KEGS

BACKGROUND OF THE INVENTION

In brewing operations, bungs, either wooden or plastic, must be removed from the bung hold in the keg prior to washing the keg and refilling with beer. In the past, bungs have been removed by a machine such as disclosed in U.S. Pat. No. 3,174,650. In the bung removing machine as described in the aforementioned patent, the keg is supported on a roller cradle and rotated to position the bung downwardly. An auger is then moved upwardly to penetrate and remove the bung from the keg.

More recently, multi-station bung removing machines have been used, such as disclosed in U.S. Pat. No. 3,613,332. In the apparatus of that patent, a walking beam moves the keg sequentially between a series of stations. Initially the walking beam moves the keg from a receiving station to an orienting station where the keg is rotated about its axis to position the bung downwardly. After orienting, the keg is then moved to a debunging station where an auger penetrates and removes the bung. Following removal of the bung the keg is transferred to a probe or sensing station where the presence of an improperly removed bung is sensed, and the keg is then transferred to a reject station where kegs having improperly removed bungs are rejected from the line. Kegs with properly removed bungs are delivered to a discharge conveyor for subsequent washing and filling.

SUMMARY OF THE INVENTION

The invention is directed to an improvement to the multistation bung removing apparatus as disclosed in U.S. Pat. No. 3,613,332. In accordance with the invention, a walking beam transfer mechanism moves each keg sequentially from a receiving station on a feed conveyor to an orienting station, a debunging station, a probe station, a reject station, to a discharge conveyor.

The feed conveyor includes a series of pivotable lever arms which serve to space the kegs along the conveyor. When the keg at the receiving station is removed from the feed conveyor, the next succeeding keg is automatically indexed to the receiving station and each following keg is moved forwardly incrementally on the feed conveyor..

The feed conveyor, as used in the invention, prevents keg-to-keg contact thereby reducing the noise level and potential damage to the kegs. As the feed conveyor has a substantial length, it increases the accumulation zone for storage of kegs prior to their being fed to the debunging apparatus.

At the orienting station the keg is supported on rollers and drive wheels engage the upper surface of the keg to rotate the keg about its axis. A pair of sensors are utilized at the orienting station with one sensor being positioned to sense the valve boss or rib on the head of the keg and thereby reduce the speed of rotation. The second sensor senses the position of the non-metallic bung and stops rotation of the drive mechanism when the bung is positioned downwardly.

The use of the pair of sensors reduced the magnitude of rotation of the keg to position the bung downwardly, as opposed to a system employing only a single sensor. In addition, more consistent sensing is achieved in that a more accurate sensing signal can be received from sensing the boss or rib on the keg head, particularly if the wall of the keg is dented.

As an added feature, a pair of wheels straddle the sensor which senses the presence of the bung, and the wheels ride on the surface of the keg to follow the contour of the keg and insure that the sensor is uniformly spaced from the keg surface at all times.

The auger which serves to remove the bung, is driven by a reversible hydraulic motor and after the auger has penetrated the bung, the auger is moved downwardly and its rotation reversed. The bung is stripped from the auger as the auger is lowered by engagement of the bung with a stripping mechanism that includes a series of sharpened bits. This construction enables wood as well as plastic bungs to be readily stripped from the auger after removal of the bung from the bung hole.

To insure removal of the bung from the stripping mechanism, a blow-off conduit is located adjacent to the stripping mechanism and the exhaust air from pneumatic cylinders on the machine is discharged through the conduit. The resulting air flow serves to remove the stripped bungs from the stripping mechanism.

A mechanical probe mechanism is located at the probe station, and the probe incorporates self-aligning features in which the probe is mounted through a wobble bearing to a supporting arm and is spring loaded to an outer position. This construction provides universal movement for the probe and aids in centering the probe within the bung hole, as the keg is lowered to the probe station.

If the probe senses the presence of an improperly removed bung, a signal is transmitted to the reject station and the keg with the improperly removed bung is rejected from the line. The rejected keg moves down a chute and is transferred to a conveyor which is similar in construction to the feed conveyor and prevents keg-to-keg contact of the rejecting kegs.

Other objects and advantages will appear in the course of the following description.

DESCRIPTION OF THE DRAWINGS

The drawings illustrate the best mode present contemplated of carrying out the invention.

In the drawings:

FIG. 4 is a section taken along line 4—4 of FIG. 2;

FIG. 9 is an enlarged fragmentary side elevation of the bung removing station;

FIG. 10 is a section taken along line 10—10 of FIG. 9;

FIG. 11 is an enlarged vertical section showing the auger and stripping mechanism at the bung removing station;

FIG. 17 is a section taken along ling 17—17 of FIG. 15;

FIG. 18 is a side elevation of the pusher mechanism with parts broken away and showing an adapter to be used for smaller sized kegs;

FIG. 19 is a top plan view of the structure shown in FIG. 18;

DESCRIPTION OF THE PREFERRED EMBODIMENT

Figure 1:
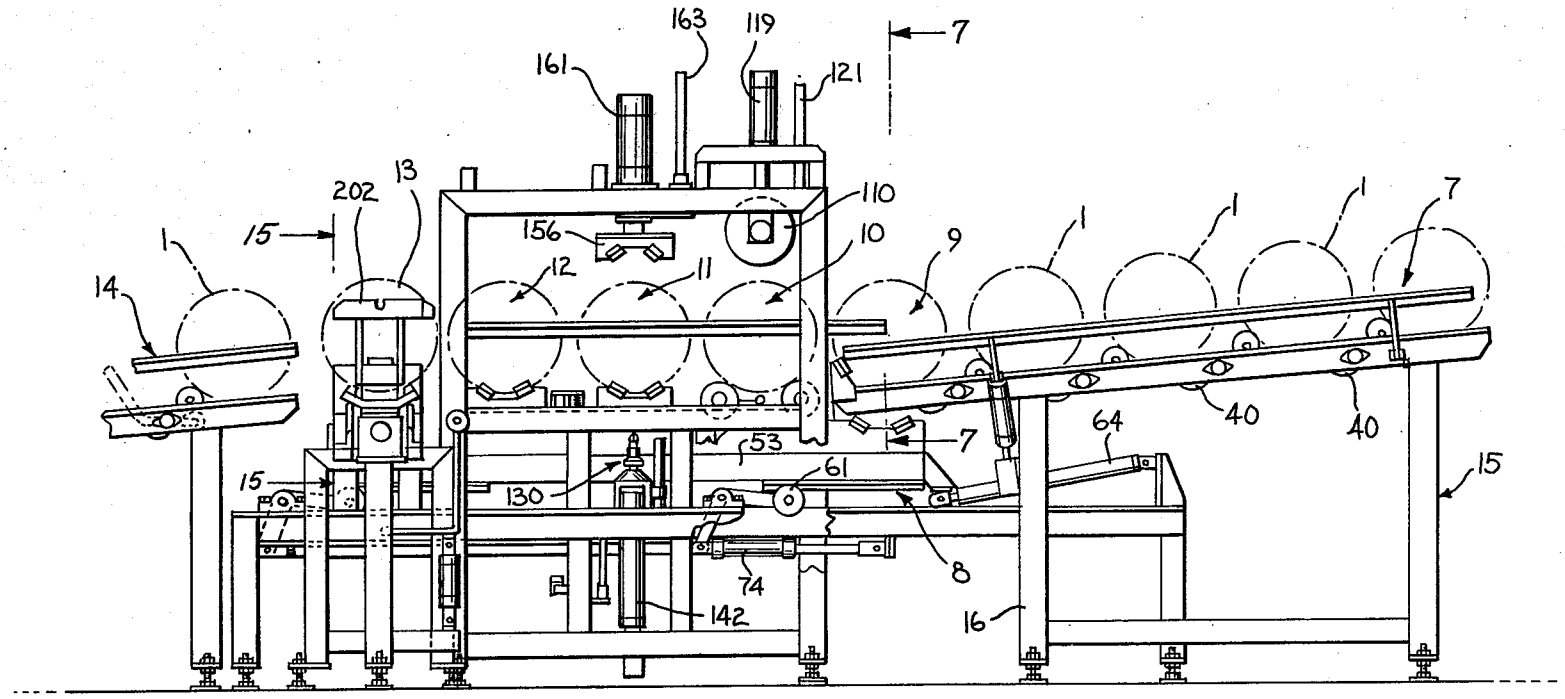
FIG. 1 is a side elevation of the bung removing apparatus of the invention.

The drawings illustrate an apparatus for removing the wooden or plastic bungs from kegs 1 formed of stainless steel or other metal. The sidewall or shell of the keg 1 is formed with a bung hole bordered by a flange 2 and the bung 3 is installed in the bung hole at the time of fitting and remains in position until after the contents of the keg have been dispensed and the keg has been returned to the brewery or other filling site.

The keg 1 is also formed with a pair of heads 4 having central recessed areas 5 and a dispensing valve 6 is secured within an opening in one of the heads. The dispensing line and pressure line are adapted to be connected to the valve 6. during use.

The debunging apparatus of the invention includes a feed conveyor 7 to receive the keg 1 and a walking beam 8 transfers the keg progressively from a receiving station 9 at the end of the feed conveyor 7 to an orienting station 10, a debunging station 11, a probe station 12, a rejection station 13 to discharge conveyor 14.

The feed conveyor 7 comprises a frame or supporting structure 15 composed of a series of vertical legs 16, and cross beams 17 are secured to the upper ends of legs 16 and the legs 16 are connected by longitudinal beams 18. A pair of longitudinal, inclined rails 19 are mounted on the crossbeams 17, and extensions 20 extend downstream from beams 17 and serve to support the cantilevered ends of the rails 19.

As best shown in FIG. 4, each rail 19 is angle-shaped in section and a quarter round 21 is mounted on the upper edge of the vertical flange of each rail. A plastic wear strip 22 is snap fitted onto the quarter round 21. The wear strips formed of a material having a low coefficient of sliding friction, such as polyethylene, and serve to support the kegs 1 as they roll down the inclined rails 19 of the conveyor.

Figure 2:
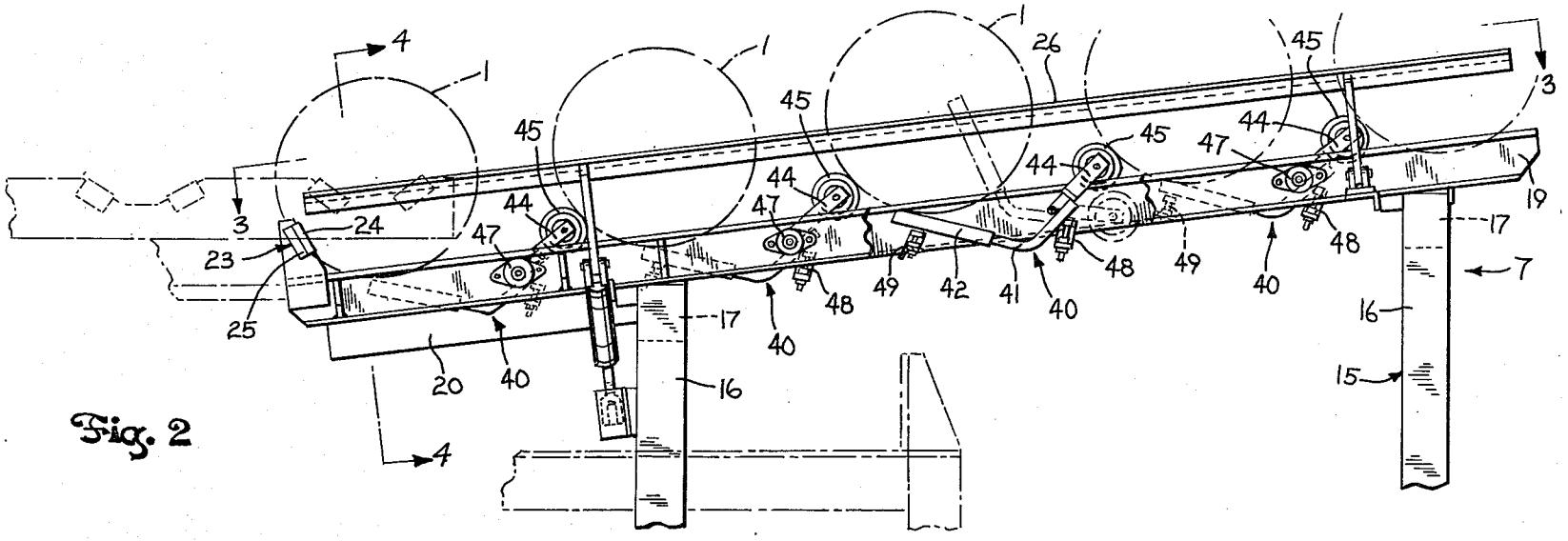
FIG. 2 is a side elevation of the feed conveyor.
Figure 3:
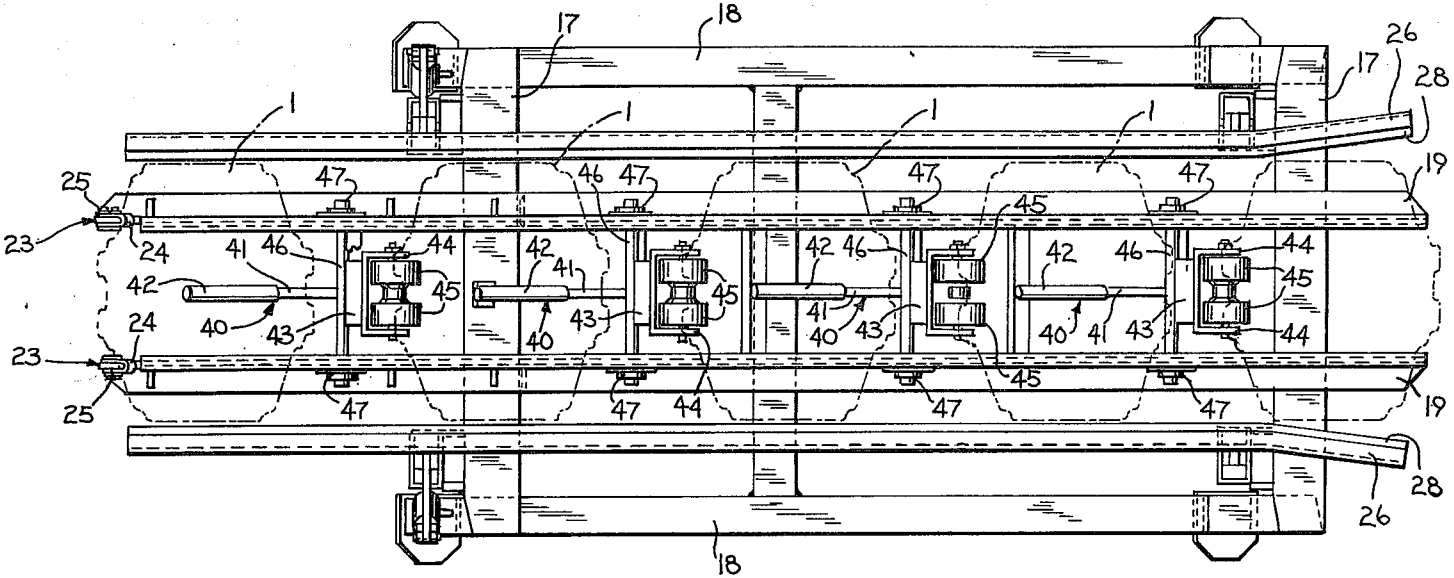
FIG. 3 is a top plan view of the feed conveyor.

Located at the downstream of the feed conveyor are a pair of end stops 23 which extend upwardly from the respective rails. A pad 24 or cushion is secured to the edge of each end stop 23 and is retained on the stop by means of retaining plates 25. As shown in FIGS. 2 and 3, the downstream keg on the conveyor 7 is stopped by the end stops 23.

To guide the keg 1 in movement along the conveyor 7, a pair of guide rails 26 are located along the sides of the conveyor. As shown in FIG. 4, each guide rail 26 has an angle section and a quarter round is secured to the edge of the horizontal flange of each guide rail. Wear strips 28, similar to wear strips 22, are secured to the quarter round 27 and during movement of the kegs will be guided by the wear strips 28.

The apparatus is intended to debung two sizes of kegs, such as a half barrel and a quarter barrel. Because of this, the guide mechanism is adjustable between an outer position, as shown in the full lines of FIG. 4 for use with half barrels, to an inner position, as shown by the phantom lines in FIG. 4, for use with quarter barrels. To move the guide rails 26 between the outer and inner positions each guide rail is mounted on the upper end of a vertical arm 29 which is attached to a horizontal arm 30. The arms 29 and 30 are pivoted to lugs 31 which extend upwardly from base 32 attached through brackets 33 to the frame.

To pivot the arms 29 and 30 about the lugs 31, the outer end of each horizontal arm 30 is pivotally connected to lugs 34 on the end of a cylinder 35. A ram 36 is slideable within the cylinder and the outer end of the ram carries a clevis 37 which is connected to a bracket 38 mounted on the frame. By extending the ram 36, the arms 29 and 30 will be pivoted inwardly to move the guide rail 26 from the outer position to the inner position.

The kegs 1 are spaced along the feed conveyor 7 to prevent keg-to-keg contact by a series of pivotable lever units 40. Each lever unit 40 includes an arm 41 having its free end covered with a sleeve 42 of plastic tubing. The arm is secured to a central section 43 and ears 44 extend outwardly from the section 43 and a pair of rubber wheels 45 are journalled between the ears.

A shaft 46 is integrally connected to the central section and the ends of the shaft are journalled within bearings 47 mounted on the outer surface of the vertical flanges of rails 19. With this construction the lever arm 41, central section 43, rollers 45 and shaft 46 comprise an integral unit which is pivotable about the axis of shaft 46.

Due to the distribution of weight about the pivotal axis 46, the rollers 45 will tend to pivot downwardly by gravity, as shown by the phantom lines in FIG. 2, and adjustable stops 48 are mounted on the frame in position to be engaged by section 43 and limit the downward movement of the rollers 45.

Similarly, adjustable stops are mounted on the frame in position to be engaged by the arms 41 when the lever units are pivoted in the opposite direction.

Due to the weight distribution, the arms 41 are normally in an upper position, as shown by the phantom lines in FIG. 3, when there are no kegs on the conveyor. As a keg 1 is moved onto the conveyor 7, the keg will roll downwardly along the rails 19 and in turn pivot each lever arm 41 downwardly. When the first keg engages the end stops 23 the corresponding arm 41 will be restrained against upward pivotal movement so that the wheels 45 associated with the first lever unit will be in an upper position. The next keg being moved downwardly along the rails 19 will engage the wheels 45, which serve as a stop, and with the keg stopped in this position, the lever arm 41 of the second lever unit 40 will be restrained against upward movement, thereby positioning wheels 45 of that unit in an obstructing position for the next keg. Thus, the lever units 40 automatically space the kegs along the conveyor 7 and prevent keg-to-keg contact, thereby reducing the noise level and preventing potential damage to kegs.

When the keg at the receiving station 9 at the downstream end of the conveyor 7 is removed from the conveyor by the walking beam 8, the arm 41 of the downstream lever unit 40 will pivot upwardly, and correspondingly the wheels 45 associated with that lever unit will pivot downwardly, to enable the second keg in the row to move downwardly on the rails to engage the end stops 23.

Thus, the conveyor acts to automatically feed the kegs to the receiving station 9 at the end of the conveyor and to space the kegs apart so there will be no keg-to-keg contact.

The walking beam 8 serves to transfer the keg 1 at the receiving station 9 on feed conveyor 7 to the orienting station 10. The walking beam 8 is composed of longitudinal box-shaped beams 53 which are connected at their ends by end beam 54. Plates 55 extend upwardly from each beam 53 and the upper edges of the plates 53 define a series of cradles 56 which are adapted to receive the kegs 1. Each cradle 56 is bordered by a pair of pads 57 formed of polyurethane or the like which are attached to the respective plates 55 by retaining plates 58.

Figure 5:
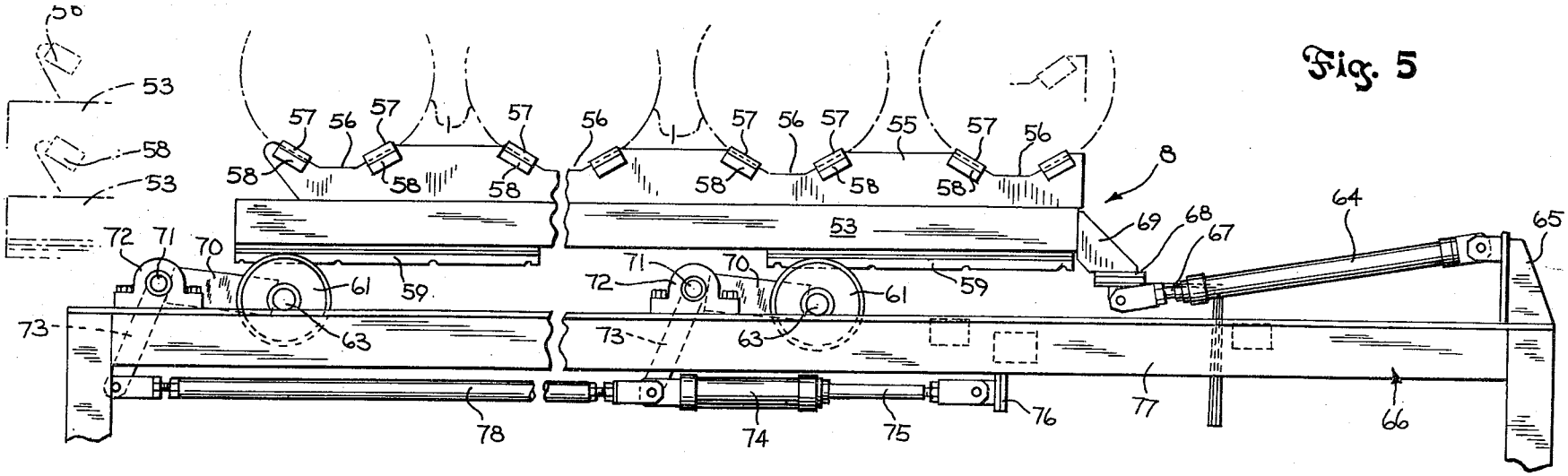
FIG. 5 is a side elevation of the walking beam transfer mechanism.
Figure 6:
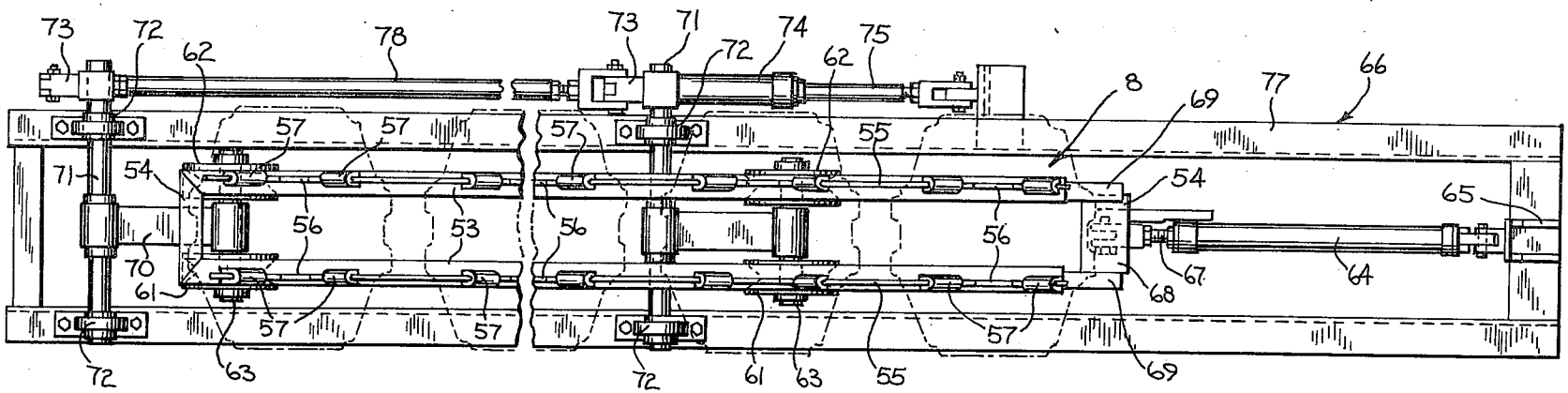
FIG. 6 is a top plan view of the transfer mechanism shown in FIG. 5.

The walking beam 8 is adapted to move in a generally rectangular path of movement lifting the key 1 upwardly from the receiving station 9, moving the keg forwardly to a position over the orienting station 10, lowering the keg 1 to the orienting station and then returning rearwardly to its original position. To guide the walking beam in forward and rear motion, two pair of tracks 59 and 60 are secured to the under surface of the beam 53. As best illustrated in FIG. 5, the tracks 59 are adapted to ride within the central grooves of rollers 61, while tracks 60 ride on the peripheral surfaces of rollers 62. Rollers 61 and 62 are mounted on transverse shafts 63.

The walking beam 8 is moved in a forward and rear direction by a hydraulic cylinder 64 having one end pivotedly connected to vertical support 65 of main frame 66. A ram 67 is slidable within the cylinder 64 and is pivotally connected to a plate 68 supported from extensions 69 which extend rearwardly from each of the beams 53. By extension and retraction of the ram 67 the beams 53 and plates 55 will be moved in a front-to-rear direction.

To move the walking beam vertically each of the shafts 63 carries an arm 70 that is connected to shaft 71 that is journalle for rotation within bearings 72 mounted on the main frame 66. An arm 73 extends downwardly from the outer end of each shaft 71 and the lower end of one of the arms 73 is pivotally connected to a lug on the end of a cylinder 74, and the ram 75 of cylinder 74 is connected to a bracket 76 depending from beam 77 of frame 66. An adjustable connecting rod 78 connects the arms 73 at the forward and rear ends of the walking beams so that the arms will be moved in unison.

With the rams 75 extended the walking beam will be in the lower position, as shown in FIG. 5. By contracting the ram 75 the rollers 61 and 62 will be pivoted upwardly to thereby move the beams 53 to the upper position.

To move the keg 1 from the receiving station 9 on conveyor 7 to the orienting station 10, the ram 75 of cylinder 74 is initially retracted causing the beam to move to its upward position. Cylinder 64 is then extended to move the beam 53 and the keg 1 to its forward position. The ram 75 is then extended causing the beam 53 and the keg to lower to the orienting station, and when the keg is supported at the orienting station, the cylinder 64 is then operated to return the walking beam to its original position.

Figure 8:
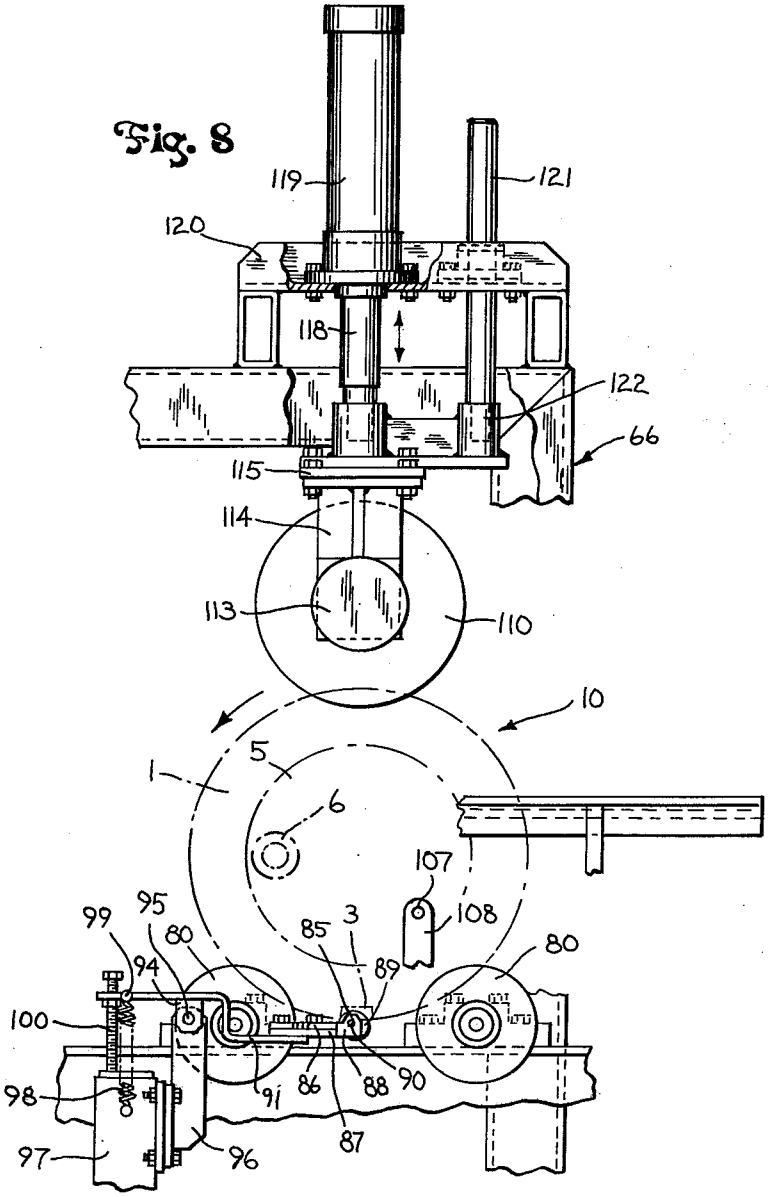
FIG. 8 is a section taken along line 8—8 of FIG. 7.
Figure 7:
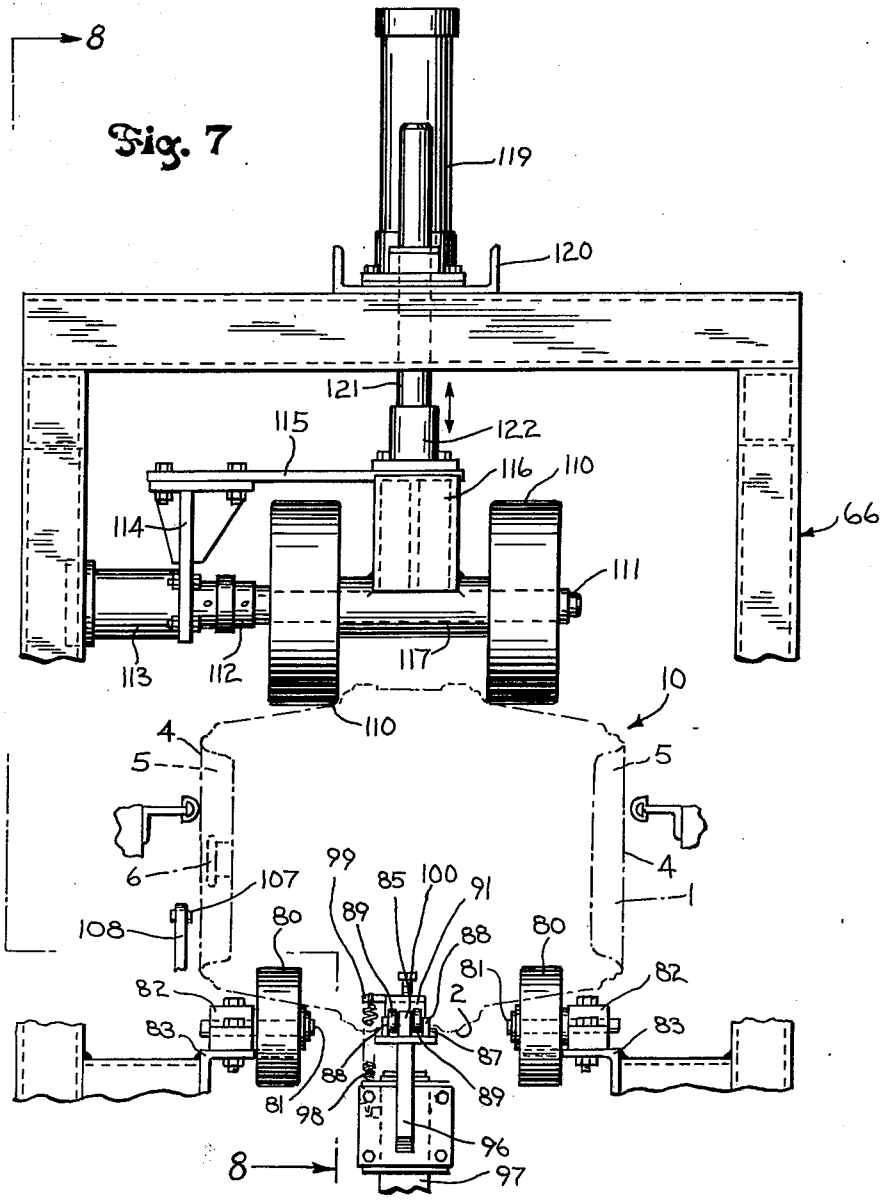
FIG. 7 is a section taken along line 7—7 of FIG. 1 showing the orienting station.

At the orienting station 10, as shown in FIGS. 7 and 8, the keg is supported on two pair of rollers 80 as it is rotated about its axis. As best shown in FIG. 7, each of the rollers 80 is mounted on a shaft 81 which is clamped within a bracket 82 mounted on angle 83 which is connected to the frame 66 of the machine. The walking beam 8, not shown in FIG. 7, is located between the rollers 80 of each pair so that when the walking beam moves to its lowermost position the keg, which is supported on the plates 55 of the walking beam, will be deposited on the rollers 80.

Figure 22:
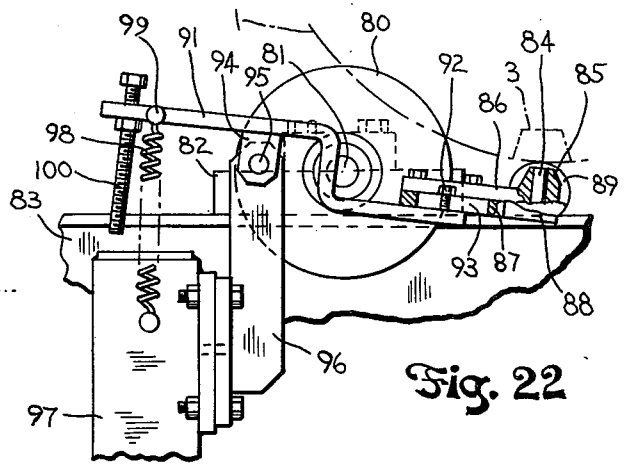
FIG. 22 is an enlarged fragmentary elevational view with parts broken away showing the bung sensor assembly.

At the orienting station 10, the keg is rotated sufficiently to position the bung 3 downwardly, and in accordance with the invention, a sensor 84, which senses the presence of the non-metallic bung, is mounted within an opening in end section 85 of bracket 86 that is secured to mounting plate 87. As best shown in FIGS. 7, 8 and 22, section 85 is located between a pair of spaced flanges 88 on mounting plate 87, and positioned between each flange 88 and the section 85 is a wheel 89, and the axle 90 of each wheel extends outwardly through an opening in the respective flange 88.

Wheels 89 are adapted to ride on the outer surface of the keg as the keg is rotated and the outer periphery of each wheel is slightly above the upper extremity of the sensor.

Mounting plate 87 is connected to a support bracket 91 by bolts 92 that extend through slots 93 in the mounting plate. The slotted connection permits adjustment of the mounting plate 87 and sensor 84 with respect to the bracket 91.

To mount the bracket 91 for pivotal movement in a vertical plane, the central portion of bracket 91 is provided with a pair of spaced, depending lugs 94 that are pivoted through pin 95 to the upper end of arm 96 secured to frame member 97.

The sensor 84 and wheels 89 are urged upwardly into contact with the keg by spring 98 which is connected between lug 99 on the end of bracket 91 and the frame member 97. An adjustable stud 100 is threaded within an opening in the end of bracket 91 and serves as a stop to limit the upper position of the sensor 84 under the force of spring 98. As the keg is lowered onto the rollers 80, the wall of the keg will depress the sensor 84 against the force of spring 98. The pivot pin 95 is at a height approximately midway between the position of the sensor when operating with half barrel kegs and the position of the sensor when operating quarter barrel kegs, so that the sensor will be operable with both sized kegs without adjustment or modification.

In addition to the sensor 84 which senses the presence of the non-metallic bung 3, a second sensor 107 is employed which senses the presence of the valve 6 on the head of the keg. The second sensor 107 can take the form of a photoelectric cell which is mounted on a bracket 108 attached to the frame. The sensor 107 is positioned so that it will sense the valve 6 as the keg is rotated, as will be more fully described hereinafter.

The keg 1 resting on rollers 80 at orienting station 10 is rotated about its axis by a pair of wheels 110 having pneumatic tires that engage the surface of the keg. As shown in FIG. 7, wheels 110 are mounted on a horizontal shaft 111 that is connected via coupling 112 to the drive shaft of hydraulic motor 113 so that a direct drive is provided to the wheels 110.

Motor 113 is carried by a vertical plate 114 which depends from a horizontal plate 115. A post 116 extends downwardly from the plate 115 between wheels 110 and the lower end of the post is connected to a bushing bracket 117 within which the shaft 111 is journalled.

With this construction, the motor 113, wheels 110, plates 114 and 115 and post 116 constitute an integral drive unit which can be raised and lowered.

To move the drive unit vertically, the lower end of a ram 118 of pneumatic cylinder 119 is threaded in a boss mounted on the upper end of post 116. Cylinder 119 is mounted on a channel 120 that is supported on the main frame 66.

To aid in guiding the ram 118 in vertical movement, the lower end of a vertical guide rod 121 is threaded in a boss 122 which is mounted on plate 115, and the upper end of guide rod 121 is guided for sliding movement within a bushing 123 mounted on channel 120 that carries the cylinder 119.

Following orientation of the keg 1 at the orienting station 10 to locate the bung 3 downwardly, the keg is transferred by the walking beam 8 to the debunging station 11. At the debunging station, as shown in FIGS. 9–11, the keg is supported by a pair of cradles 126 which are supported from angles 127 attached to the frame. Each cradle 126 is provided with a pad 128, formed of polyurethane or the like, which is secured to the cradle by retaining plates 129. The polyurethane pad prevents slippage of the keg on the cradles during removal of the bung.

An auger assembly 130 is mounted between the cradles 126 and includes an auger 131 which is adapted to penetrate the bung as the auger assembly is moved upwardly. As best shown in FIG. 11, auger 131 is attached to a coupling 132 which in turn is keyed to the drive shaft 133 of hydraulic motor 134. Surrounding the coupling is a shield 135 having an inclined angular surface 136 which deflects beer and other foreign materials outwardly away from the drive connection. As shown in FIG. 11, the peripheral edge of shield 135 terminates in a downwardly extending flange 137 which is located radially outward of the upstanding angular lip 138 of ring 139 that is attached to the frame 140. The shield 135 rotates with the head 132, while the ring 139 and frame 140 are stationary. The lip 138, in combination with the flange 137, provides a labirinth-type of clearance which prevents beer, and other foreign materials from contacting the drive connection.

As illustrated in FIGS. 9 and 10, the hydraulic motor 134 is located within the frame 140 and is connected to the frame so that the motor 134 and frame 140 constitute an integral unit.

The auger assembly is moved vertically by a hydraulic cylinder 142 which is connected to the bottom plate 143 of frame 140. A piston rod 144 is slidable within the cylinder and the lower end of the piston rod is connected to bracket 145 of the main frame 66. By extending the piston rod 144, the auger assembly will be moved upwardly to thereby cause the auger to penetrate the bung 3.

The auger assembly is guided in vertical movement by a pair of guide rods 146 and 147 which are mounted through brackets 148 and 149, respectively, to the frame. The guide rods 146 and 147 are adapted to slide within bushings 150 and 151, respectively, secured to the frame 140 as the auger assembly is moved vertically.

The stroke of movement of the auger assembly 130 is controlled by a pair of sensors 152 and 153 that are mounted in vertical spaced relation on frame 66. As shown in FIG. 9, an actuator bar 154, extends outwardly from bushing 151 and moves in a path in close proximity to sensors 152 and 153. As the auger assembly 130 moves upwardly, the sensor 152 will sense the presence of bar 154 to thereby actuate the hydraulic control system to shut off the flow of hydraulic fluid to the cylinder 142 and thus limit the upward stroke of the auger assembly. On downward movement of the auger assembly, the sensor 153 will sense the presence of bar 154 to limit the downward movement of the auger assembly in the same manner.

During removal of the bung 3, the keg is held down against the cradles 126 by an upper clamp assembly. The upper clamp assembly includes a pair of cradles 156, similar to cradles 126, and cradles 156 are carried by a beam 157. Beam 157 supports plate 158 and a boss 159 extends upwardly from the plate. The lower end of a piston rod 160 is threaded to the boss, and the rod 160 is slidable within a pneumatic cylinder 161 which is mounted on upper frame member 162. By extending the piston rod 160, the cradles 156 will be moved downwardly into engagement with the upper surface of the keg, to thereby clamp the keg during the bung removing operation.

The movement of the piston rod 160 is guided by means of a guide rod 163 which extends upwardly from plate 158 and slides within bushing 164 mounted on frame member 162 during operation of the cylinder unit.

The auger 31 is adapted to penetrate and remove both plastic and wooden bungs from the keg, and to strip the bung 3 from the auger 131 after the bung has been removed from the keg, a stripper unit 166 is utilized. Stripper unit 166 comprises a ring 167 which surrounds the coupling 132 and a series of sharpened bits 168 are located in circumferentially spaced relation on the ring. The bits 168 are mounted within slots in the ring by set screws 169. Ring 167 is fixed with respect to the frame and is connected to the frame by a bracket 170.

After the auger 131 has penetrated the bung 3, the auger assembly is lowered, thereby pulling the bung from the bung hole. As the auger assembly is lowered the rotation of the hydraulic motor 134 is reversed, and when the removed bung engages the upper edge of the stripper bits 168 the bung will be stripped from the auger and the auger will move downwardly to a level beneath the top of the stripper ring 167.

To assure removal of the dislodged bung from the stripper unit 166, an air jet is utilized which blows the removed bung from the stripper ring 167. As shown in FIG. 9, a tube 171 is mounted through a bracket 172 to the frame and the tube is connected to the exhaust of the air cylinders which operate the upper clamping units. As the air is exhausted from the clamping unit cylinders on retraction or extension of the piston rod, the exhausted air is discharged through tube 171 which terminates adjacent ring 167, and this air blast serves to blow the removed bung from the stripper ring in the event the bung did not fall from the stripper ring.

Figure 13:
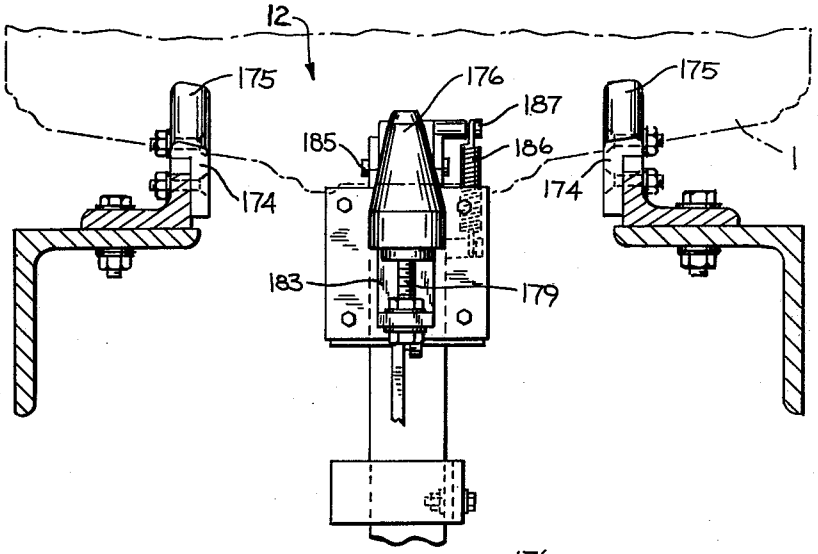
FIG. 13 is a section taken along line 13—13 of FIG. 12.
Figure 14:
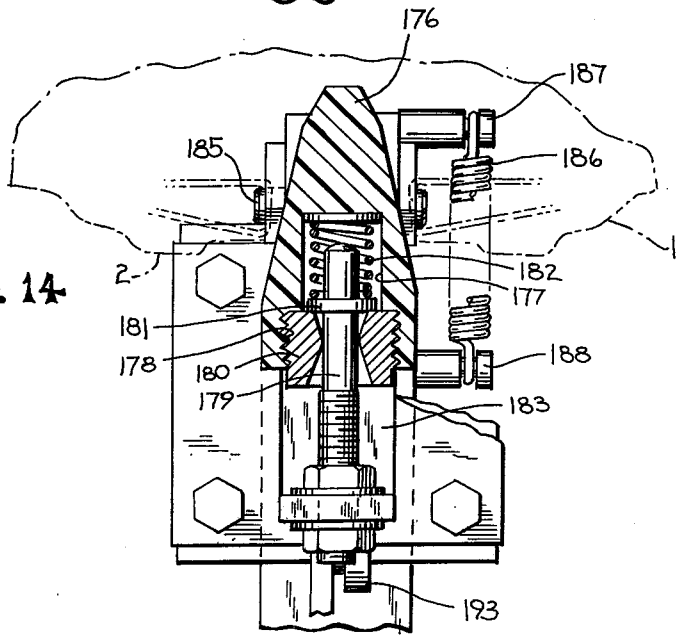
FIG. 14 is a section taken along line 14—14 of FIG. 12.
Figure 12:
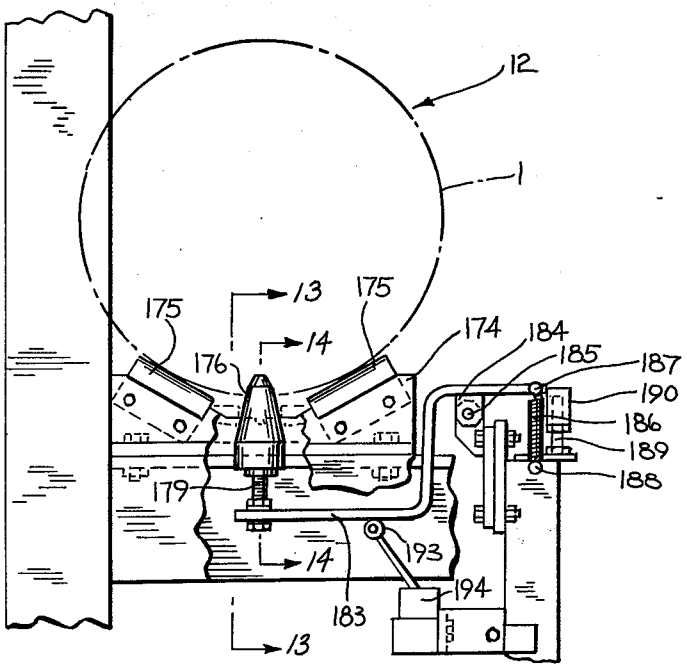
FIG. 12 is an enlarged fragmentary side elevation of the probe station.

After removal of the bung from the keg, the keg is transferred to the probe station 12 where the keg is checked for proper removal of the bung. At the probe station, as illustrated in FIGS. 12–14, the keg is supported with the bung hole facing downwardly on a pair of cradles 174 which are mounted on the beams 127 of the frame. Pads 175 formed of polyethylene or the like, are bolted to each of the cradles 174 and the polyethylene pads, having a relatively low coefficient of friction, will permit some movement of the keg on the cradles.

A tapered plastic probe 176 is mounted between the cradles 174 at the probe station 12, and as the keg is lowered by the walking beam 8 into the cradles, the probe 176 is adapted to enter the bung hole. As has been shown in FIG. 14, the probe 176 is provided with a central bore 177 and an enlarged recess 178 in its base. A vertical shaft 179 extends upwardly within the recess 178 and bore 177 and is mounted within a wobble or swivel bearing 180 that is threaded within recess 178. As illustrated in FIG. 14, a washer 181 is mounted on the upper end of the shaft 174 and bears against the upper end of bearing 180, and a spring 182 is interposed between the washer 181 and the bottom of the bore 177. The wobble bearing 180, in conjunction with the spring 182, provides a self-centering feature for the probe 176 in the event the probe is not directly aligned with the bung as the keg is lowered. The spring 182 permits the probe to move downwardly against the force of the spring, while the wobble bearing 180 enables the probe to tilt with respect to the axis of shaft 179.

The lower end of shaft 179 is connected to an arm 183 that is pivoted to bracket 184 on the frame by pin 185. The probe 176 and arm 183 are urged upwardly by a spring 186. One end of the spring 196 is connected to a pin 187 on the outer end of arm 183 while the opposite end of the spring is connected to a pin 188 on the frame. The force of the spring will tend to pivot the probe 176 upwardly, and the uppwer position of the probe is limited by engagement of the head of an adjusting stud 189 with the frame. The adjusting stud is threaded with a boss 190 mounted in the end of the arm 183.

If the bung has been properly removed from the keg, the probe 176 will enter the bung hole as the keg is lowered, and there will be no movement or deflection of the supporting arm 183. In the event that the bung has not been properly removed, the probe 176 will engage the bung, or portion of the bung, remaining in the hole as the keg is lowered, thereby pivoting the probe and arm 183 downwardly. A feeler 193 connected to limit switch 194 is disposed in engagement with the lower surface of arm 183, and if the arm pivots downwardly, the limit switch will be actuated to thereby generate a signal which will act to reject the keg when the keg has been transferred to the reject station.

The keg is transferred by the walking beam 8 from the probe station 12 to the reject station 13 and is lowered onto a pair of cradles 195 which are supported by a vertical column 196. Polyethylene pads 197 are mounted on the ends of each cradle 195 through spacers 198 and the keg rests on the pads 197.

Figure 15:
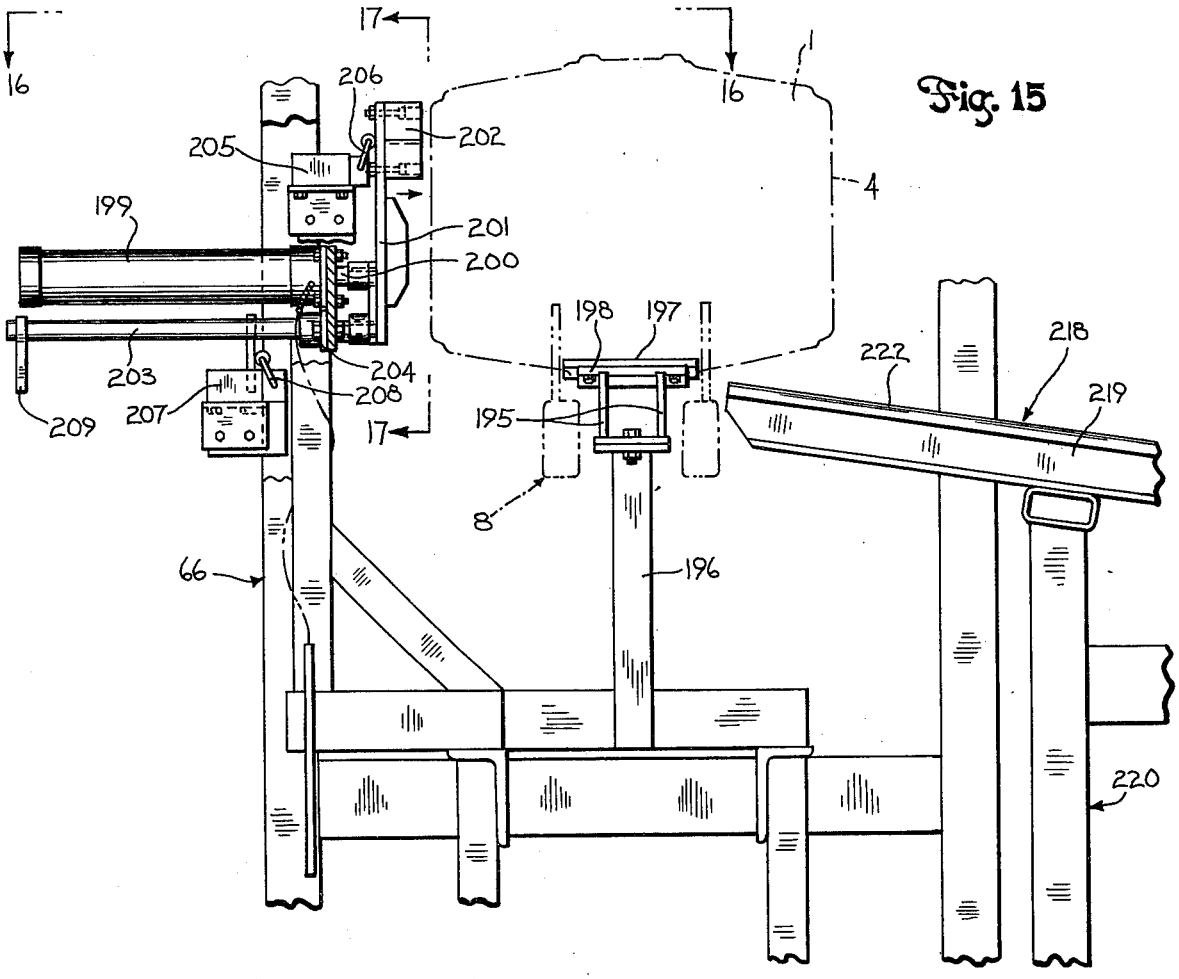
FIG. 15 is a section taken along line 15—15 of FIG. 1 showing the reject station.

If a signal was generated at the probe station 12 to reject the keg, a pusher assembly is actuated to push the keg axially from the cradles 195. As shown in FIG. 15, the pusher assembly includes a pneumatic cylinder 199 which is mounted on the frame and the piston rod 200 of cylinder 199 is connected through a plate to the lower ends of vertical supports 201. A pusher pad 202 is mounted on the upper end of the plate and is adapted to engage the end of the keg as the cylinder is actuated to push the keg axially from the cradles 195, as indicated by the arrow in FIG. 15.

To aid in guiding the piston rod in movement, a guide rod 203 is mounted on the plate that connects support 201 and is adapted to slide within bushing 204 attached to the frame as the piston rod is extended and retracted.

Figure 16:
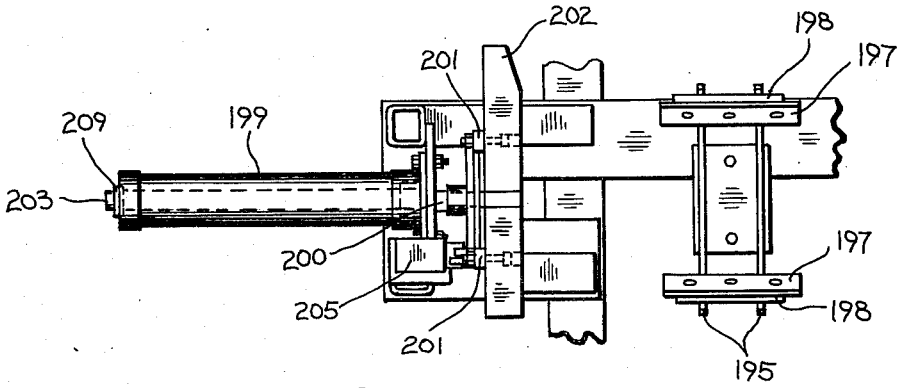
FIG. 16 is a section taken along line 16—16 of FIG. 15.

The stroke of the cylinder 199 is controlled by a pair of limit switches, as illustrated in FIGS. 15 and 16. Limit switch 205 is mounted on the frame and is provided with an arm 206 which is engaged by the pusher plate 201 as the piston rod is retracted to thereby stop the inward stroke of the piston rod. The outer stroke of the piston rod is controlled by a limit switch 207 having an arm 208 which is engaged by an actuator bar 209 connected to guide rod 203 as the piston rod 200 is extended. The limit switches 205 and 207 operate to insure that the keg is fully removed from the reject station and that the pusher plate is fully retracted prior to the next movement of the walking beam.

The pusher 202, as illustrated in FIG. 15, is adapted to be used with the larger one-half barrel kegs. In the event that smaller one-quarter barrel kegs are being processed, an adapter 210 is attached to the pusher plate 202, as illustrated in FIGS. 18 and 19. The adapter 210 includes an auxilliary pad 211, which is carried by a pair of L-shaped arms 212. Arms 212 are connected together by a bar 213 and a rod 214 is threaded within an opening in bar 213. The rod 214 is received within a slot 215 in the plate 201. Connected to the outer end of the rod 214 is a hand knob 216 and by tightening down the knob 216, auxilliary pad 211 can be firmly connected to the plate 202. As previously noted, the auxilliary pad 211 is to be used when dealing with smaller one-quarter barrel kegs.

Figure 21:
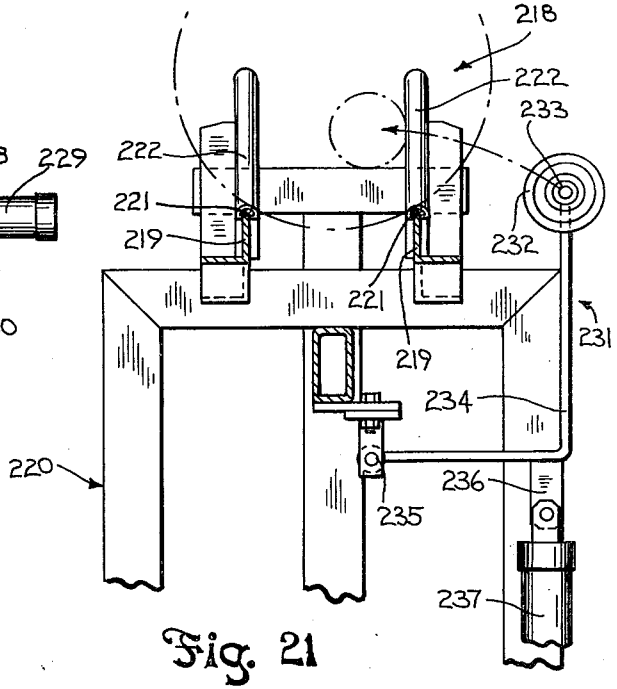
FIG. 21 is a section taken along line 21—21 of FIG. 20.
Figure 20:
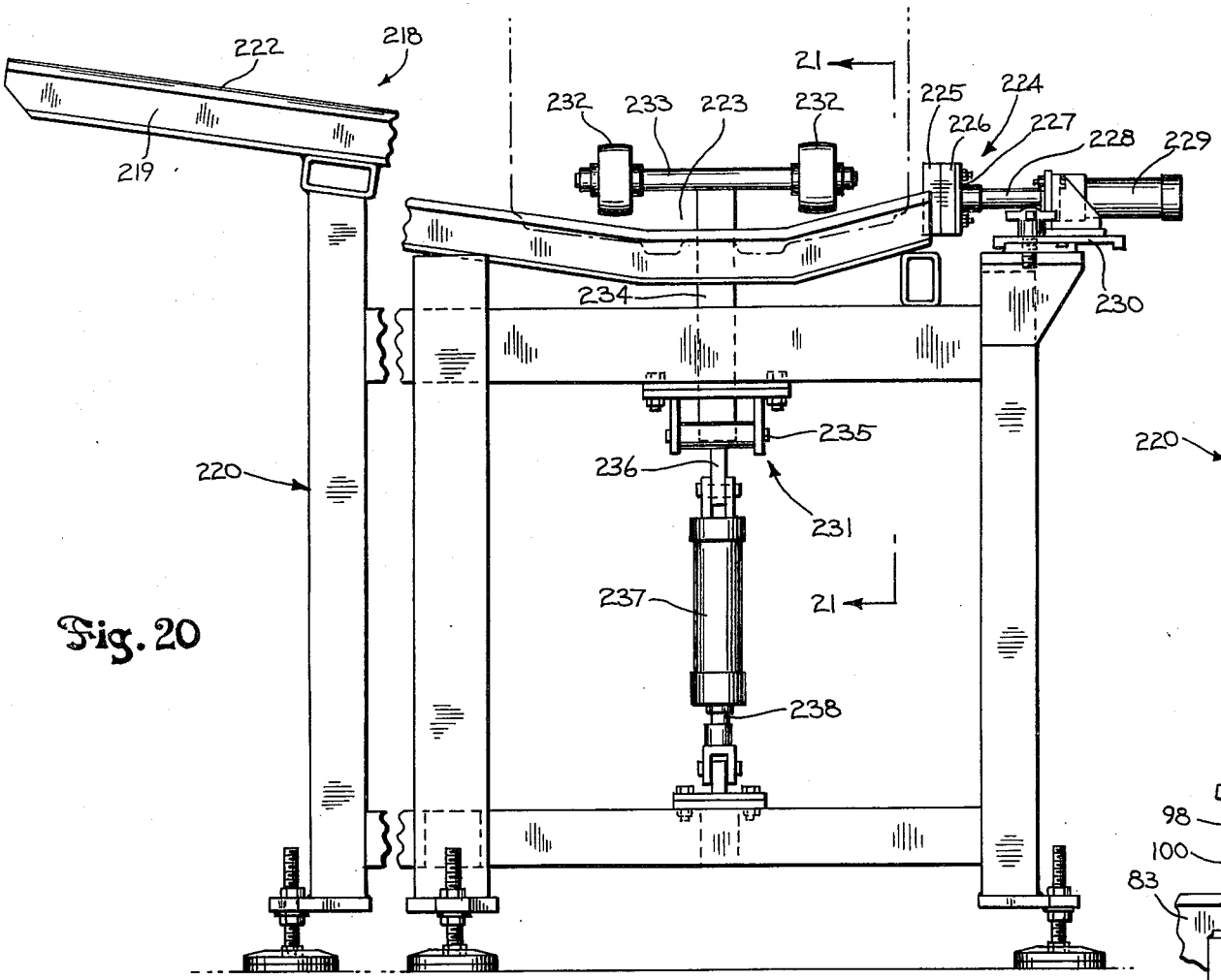
FIG. 20 is a side elevation with parts broken away of the discharge chute at the reject station.

A reject chute assembly 218, as illustrated in FIGS. 20 and 21, extends laterally from the reject station 13 and the kegs are discharged from the reject station to chute assembly 218. Reject chute assembly 218 includes a pair of spaced, inclined rails 219 which are supported on an auxilliary frame 220, and the upper edge of each rail is provided with a half-round 221 which is covered by a plastic wear strip 222.

As shown in FIG. 20, the rails 219 are inclined downwardly so that the rejected keg will slide along the rails, and the outer end of each rail is curved upwardly and terminates in a saddle 223 bordered by a bumper assembly 224. The bumper assembly 224 includes an outer pad 225 of plastic material which is secured to a backing plate 226 formed of rubber, which in turn, is secured to a metal plate 227.

The outer end of a piston rod 228 is attached to the backing plate 227, and rod 228 is slidable with a pneumatic cylinder 229 that is mounted on bracket 230 attached to the frame 220. The bumper unit 224 acts to cushion the impact of the rejected kegs riding down the rails 219. The pads 225 and 226 provide a cushion and the cylinder serves as a shock absorber to absorb the impact of the moving keg.

The keg located in the saddle 223 at the lower end of the rails 219 is pushed from the rails onto a reject conveyor not shown, by a pusher unit indicated generally by 231. The pusher unit includes a pair of rollers 232 which are mounted on a horizontal shaft 233, and shaft 233 is carried by the upper end of an L-shaped arm 234. As illustrated in FIG. 21, the horizontal section of arm 234 is pivoted at pivot 235 to the frame, while the central section of the arm 234 carries a lug 236 which is pivotally connected to the upper end of a cylinder 237. The piston rod 238 of cylinder 237 is pivotally connected to the frame 220. As the rod 238 is extended, the arm 234 will be pivoted inwardly to a position over the rails 219 to push the keg laterally from the rails onto the reject conveyor.

The kegs which are not rejected at the keg reject station 13 are transferred by the walking beam 8 to the discharge conveyor 14. The discharge conveyor 14 has a construction similar to that of the feed conveyor 7 and includes a pair of spaced inclined rails 239 and a series of lever assemblies 240, similar in construction and function to lever assemblies 40, which space the kegs apart on the rails 239 and prevent keg-to-keg contact.

OPERATION

The kegs are moved onto the feed conveyor 7 and the first keg in the line up will move down the rails 19 and engage the end stop 23. The keg at the end stop will pivot the lever assembly 40 so that the rollers 45 of that lever assembly are in a position to stop the next keg moving down the conveyor. This action is repeated until the feed conveyor has a full complement of kegs.

The walking beam 8 is operated to transfer the keg from the receiving station 9 on the feed conveyor 7 to the orienting station 10 where the keg is supported on rollers 80. The drive mechanism is then lowered and hydraulic motor 113 is operated to rotate the drive wheels 110 and thereby rotate the keg about its axis. As the keg is rotated the photoelectric cell 107 will sense the difference in depth between the head of the keg and the valve 6 and when the valve breaks the photoelectric beam, a signal is generated to reduce the speed of the motor 113. The keg is further rotated until the bung 3 is sensed by the sensor 84 and this generates a second signal to stop the drive mechanism, so that the bung will be positioned downwardly.

After the keg has been oriented at the orienting station 10, the walking beam 8 is again actuated to transfer the keg to the debunging station. With the keg resting on the cradles 126, the upper clamping assembly is actuated to clamp the keg. Cylinder 142 of the auger assembly 131 is then operated to move the auger 131 upwardly, and the hydraulic motor 134 is simultaneously operated to rotate the auger. The auger 131 will penetrate the bung 3 and after moving in its full stroke of movement, the cylinder 142 is reversed to withdraw the bung from the bung hole in the keg. At this time the operation of the hydraulic motor is also reversed and the lower end of the removed bung will engage the stripper ring 167 to thereby strip the bung from the auger. The air blast through hose 171 will eject the bung from the stripper unit 166.

With the bung removed, the upper clamping unit 156 is released and the walking beam 8 is again actuated to transfer the keg to the probe station where the keg is lowered onto the probe 176. In the event the bung has been improperly or only partially removed from the bung hole, the bung will pivot the arm 183 downwardly thereby actuating limit switch 193 to generate a signal to the reject station to reject that keg when it is transferred to the reject station. If the bung has been properly removed the probe will merely penetrate the bung hole and will not pivot downwardly to actuate the limit switch.

The keg is then transferred by the walking beam 8 to the reject station, and if a signal has been received that the bung was improperly removed, the pusher plate 202 will be operated to move the keg axially onto the chute assembly 218, where it will slide down the rails 219 to the saddle 223. Cylinder 237 is then operated to pivot arm 234 upwardly and engage the rollers 232 with the keg to move the rejected keg onto a reject conveyor, not shown.

If the bung has been properly removed from the keg, the keg will not be rejected and will be transferred from the reject station 13 by walking beam 8 to the discharge conveyor 14. As previously noted, the construction of the discharge conveyor is similar to that of the feed conveyor and the kegs are moved downwardly in spaced relation on the discharge conveyor without keg-to-keg contact.

Various modes of carrying out the invention are contemplated as being within the scope of the following claims particularly pointing out and distinctly claiming the subject matter which is regarded as the invention.

I claim:

1. In an apparatus for automatically removing a bung from a bung hole in a keg, said apparatus having an orienting station for rotating the keg about its axis to position the bung downwardly and a bung removing station for removing the downwardly facing bung, the improvement comprising, support means for supporting the keg at the orienting station, drive means disposed to engage the keg and rotate the keg about its axis, first sensing means for sensing the presence of a first portion of the keg as the keg is rotated and operably connected to the drive means for reducing the speed of said drive means, and second sensing means for sensing the presence of a second portion of the keg and operably connected to the drive means for stopping operation of said drive means to stop rotation of the keg.

2. The apparatus of claim 1, wherein said first sensing means is disposed adjacent an end of the keg and disposed to sense the position of a coupling on the end of the keg, said second sensing means is disposed beneath the support means and is disposed to sense the position of a non-metallic bung located in the circumferential wall of the keg.

3. The apparatus of claim 1, wherein said support means comprises a plurality of freely rotatable members to support the keg, said drive means comprises driven wheel means to engage the surface of the keg and rotate the keg.

4. The apparatus of claim 3, and including means for raising and lowering the drive means with respect to the support means.

5. The apparatus of claim 3, wherein said wheel means includes a plurality of pneumatic tires adapted to engage the outer surface of the keg.

6. In an apparatus for automatically removing a bung from a bung hole in a keg, said apparatus having an orienting station for rotating the keg about its axis to position the bung downwardly, the improvement comprising support means for supporting the keg at the orienting station, drive means disposed to engage the keg and rotate the keg about its axis at a first speed, first sensing means located at a level above the support means for sensing the presence of a first portion of the end of the keg as the keg is rotated and operably connected to the drive means, actuation of said first sensing means disposed to reduce the speed of said drive means to a second speed slower than said first speed, and second sensing means disposed at a level beneath the support means and located to sense the position of a non-metallic bung located at the circumferential wall of the keg, said second sensing means being operably connected to the drive means and operable to stop operation of the drive means to stop rotation of the keg.

7. In an apparatus for automatically removing the bung from the bung hole in a keg, said apparatus having a bung removing station for removing the downwardly facing bung, the improvement comprising, support means to support the keg in the bung removing station, an auger assembly including a frame, an auger mounted for rotation with respect to the frame and disposed to penetrate the bung in the keg, a reversible hydraulic motor mounted on the frame and operably connected to the auger to rotate the auger about its axis, means for raising and lowering the frame, raising of the frame causing the auger to penetrate the bung and lowering of the frame causing the auger to withdraw the bung from the bung hole in the keg, and stripper means having a central opening to receive the auger, said stripper means being fixed with respect to the support means and said stripper means including a plurality of circumferentially arranged stripping bits, the lower end of the bung adapted to engage said bits as the auger assembly is lowered to thereby strip the bung from the auger.

8. The apparatus of claim 7, and including gas ejecting means disposed adjacent the stripper means and connected to a source of gas under pressure, whereby the gas being discharged from said ejecting means will blow the bung from the stripper means.

9. An apparatus for automatically removing a bung from a bung hole in a keg, said apparatus having an orienting station for rotating the keg about is axis to position the bung downwardly, a bung removing station for removing the downwardly facing bung, a probe station to sense whether the bung has been properly removed, a reject station for discharging a keg with an improperly removed bung from the apparatus, and transfer means for transferring the keg between the orienting station, the bung removing station and the probe station and the reject station, the improvement comprising, support means disposed at said probe station, a probe mechanism including an upstanding probe and probe supporting means, said probe being disposed above the level of the support means whereby the probe will penetrate the bung hole as the keg is lowered onto said support means, mounting means for mounting the probe support means for downward movement, and signalling means disposed to be actuated by downward movement of the probe support means in the event the probe engages an improperly removed bung to thereby generate a signal to cause the keg to be subsequently rejected at the reject station.

10. The apparatus of claim 9, and including means for biasing the probe support means upwardly.

11. The apparatus of claim 10, wherein said mounting means comprises a pivotal connection arranged to permit pivotal movement of said probe support means in a vertical plane.

12. The apparatus of claim 9, and including means for mounting the probe for wobble movement with respect to the probe support means.

13. The apparatus of claim 12, and including means for mounting the probe for axial movement with respect to the probe support means.

14. The apparatus of claim 10, and including a stop to limit the upward movement of the probe support means under the force of said biasing means.

15. An apparatus for automatically removing a bung from a bung hole in a keg, said apparatus having an orienting station for rotating the keg about its axis to position the bung downwardly, a bung removing station for removing the downwardly facing bung, a probe station to sense whether the bung has been properly removed and transfer means for transferring the keg between the orienting station, the bung removing station and the probe station, the improvement comprising, a supporting structure, support means at the probe station and mounted on the supporting structure to support a keg, a probe mechanism disposed at the probe station and including an upstanding probe and a probe support means to support the probe, said probe disposed above the level of the support means whereby the probe will penetrate the bung hole as the keg is lowered onto the support means at said probe station, means for mounting the probe support means for vertical pivotal movement with respect to said support means, engagement of said probe with an improperly removed bung causing said probe support means to pivot downwardly, signalling means disposed to be actuated by downward movement of the probe support means for generating a signal to effect rejection of the keg at a subsequent station, means for mounting the probe for universal movement with respect to the probe support means, and means for mounting the probe for axial movement with respect to the probe support means.

* * * * *